US007395951B2

(12) United States Patent
Clayman

(10) Patent No.: US 7,395,951 B2
(45) Date of Patent: Jul. 8, 2008

(54) STOCKING AID DEVICE

(75) Inventor: Stephen Clayman, Manchester, NH (US)

(73) Assignee: Liberty Devices, Manchester, NH (US)

( * ) Notice: Subject to any disclaimer, the term of this patent is extended or adjusted under 35 U.S.C. 154(b) by 0 days.

(21) Appl. No.: 11/549,403

(22) Filed: Oct. 13, 2006

(65) Prior Publication Data

US 2007/0084890 A1 Apr. 19, 2007

Related U.S. Application Data

(60) Provisional application No. 60/726,955, filed on Oct. 14, 2005.

(51) Int. Cl.
*A47G 25/90* (2006.01)

(52) U.S. Cl. ..... 223/112; 223/111

(58) Field of Classification Search ..... 223/111–119
See application file for complete search history.

(56) References Cited

U.S. PATENT DOCUMENTS 3,977,082 A * 8/1976 Siatkowski ..... 433/7
4,284,216 A * 8/1981 Leland ..... 223/111
5,249,720 A * 10/1993 White ..... 223/112
5,513,783 A * 5/1996 White ..... 223/112
5,593,071 A * 1/1997 Lusk ..... 223/112
5,636,774 A * 6/1997 Moscato ..... 223/112
5,769,289 A * 6/1998 Lusk ..... 223/112
6,234,369 B1 * 5/2001 Bort ..... 223/112
7,216,787 B2 * 5/2007 Delamare ..... 223/111
2004/0060950 A1 * 4/2004 Goff et al. ..... 223/112
2006/0076372 A1 * 4/2006 Delamare ..... 223/111
2007/0084890 A1 * 4/2007 Clayman ..... 223/118

* cited by examiner

*Primary Examiner*—Gary L. Welch
*Assistant Examiner*—Andrew W Sutton
(74) *Attorney, Agent, or Firm*—Bourque and Associates, PA

(57) ABSTRACT

A device, method and system for facilitating placement of a sock, stocking, or other footwear are disclosed herein. An exemplary device may have a lower member, a handle, and a spreader. The lower member may have a first side and a second side. The first side and second side are sized to fit within footwear when the lower member is in a retracted position. The handle may be coupled to the lower member and allows a user to position the lower member. The spreader means moves the first side and the second side from a retracted position to an extended position. In the extended position, the first side and second side are sized to receive a foot of the user.

15 Claims, 5 Drawing Sheets

STOCKING AID DEVICE

CROSS-REFERENCE TO RELATED APPLICATIONS

This application is related to U.S. patent application No. 60/726,955 filed Oct. 14, 2005 entitled Stocking Aid Device, which is incorporated fully herein by reference.

TECHNICAL FIELD

The present invention relates to stockings and the like, and more particularly, relates to devices for facilitating putting on stockings especially for people with limited strength and/or mobility.

BACKGROUND INFORMATION

For people with limited strength and/or mobility, such as the elderly, the ability to dress independently is of prime concern. Often, many of these people find putting on stocking and socks, particularly compression and orthopedic stockings, very challenging in part due to their relatively remote location on the body. The problem is further compounded by the design of compression and orthopedic stockings which, by their nature, are very constrictive and difficult to spread over one's foot.

Accordingly, what is needed is a device that allows someone with limited strength and/or mobility to retain their ability to dress independently. The device should preferably facilitate putting on socks and stocking, especially compression and orthopedic stockings. It is important to note that the present invention is not intended to be limited to a system or method which must satisfy one or more of any stated objects or features of the invention. It is also important to note that the present invention is not limited to the preferred, exemplary, or primary embodiment(s) described herein. Modifications and substitutions by one of ordinary skill in the art are considered to be within the scope of the present invention.

SUMMARY

The present invention is a novel device, system, and method for facilitating placement of footwear. An exemplary device may have a lower member, a handle, and a spreader. The lower member may have a first side and a second side. The first side and second side are sized to fit within footwear when the lower member is in a retracted position. The handle may be coupled to the lower member and sized to allow a user to position the lower member when the user is in a seated position. The spreader for moving the first side and the second side from a retracted position to a extended position wherein the first side and second side are sided to receive a foot of a user in the extended position.

Exemplary embodiments may have one or more of the following features. According to one exemplary embodiment, the first side and second side of the lower portion may be separated in the extended position to allow the foot of the user to fit between as the footwear is positioned on the foot. In another embodiment, the spreader may have a removable handle sized to allow the user in a seated position to turn the handle of the spreader. In another embodiment, the spreader may have a motor for turning a gear screw coupling the first side and second side of the spreader. The first side and second side may each have a heel bend configured to prevent slipping of the footwear from the lower portion. In another embodiment, the gear screw may have one or more stops to prevent over expansion or over retraction.

It is important to note that the present invention is not intended to be limited to a system or method which must satisfy one or more of any stated objects or features of the invention. It is also important to note that the present invention is not limited to the exemplary or primary embodiments described herein. Modifications and substitutions by one of ordinary skill in the art are considered to be within the scope of the present invention, which is not to be limited except by the following claims.

BRIEF DESCRIPTION OF THE DRAWINGS

These and other features and advantages of the present invention will be better understood by reading the following detailed description, taken together with the drawings wherein.

DETAILED DESCRIPTION

Figure 1:
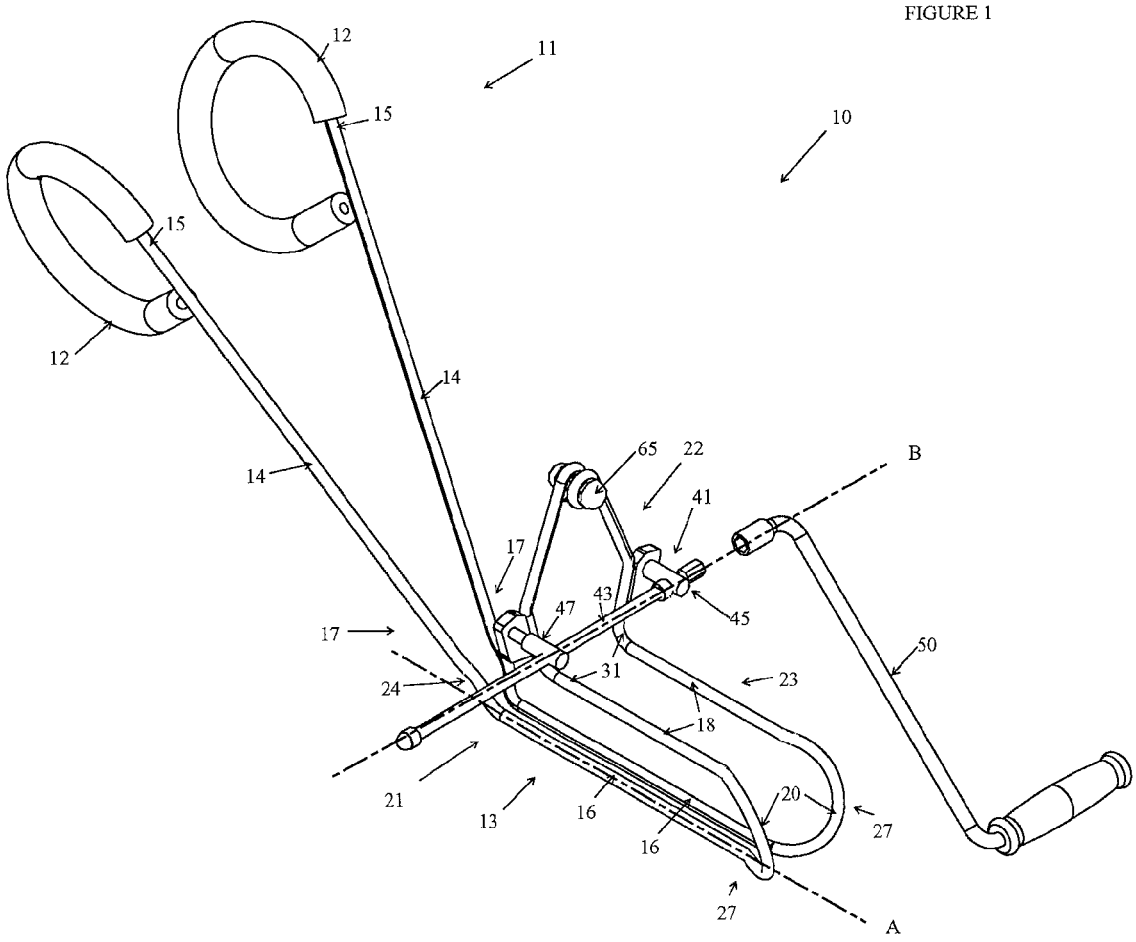
FIG. 1 is a front plan view of one embodiment of the stocking aid device according to the present invention in the retracted position.
Figure 2:
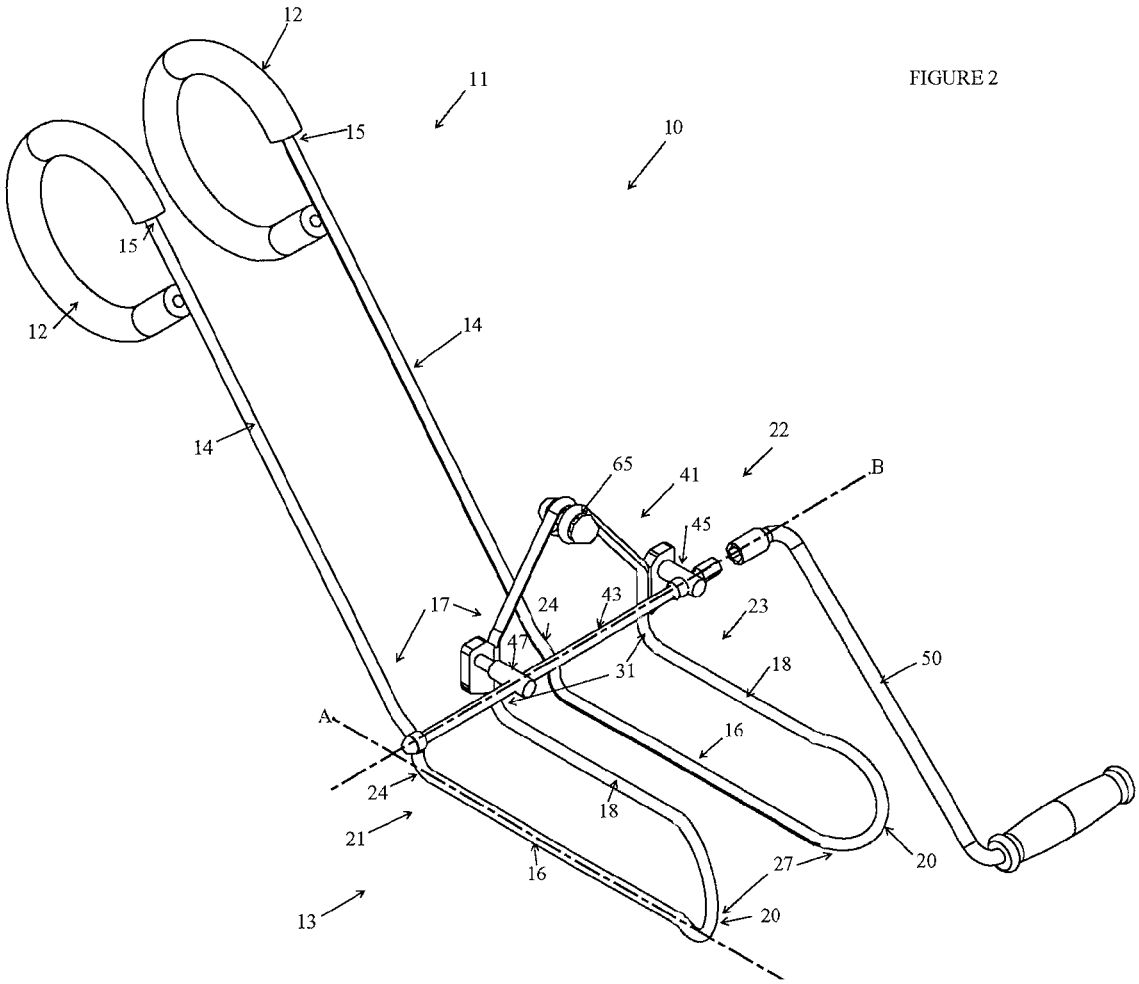
FIG. 2 is a front plan view of one embodiment of the stocking aid device according to the present invention in the expanded position.
Figure 3:
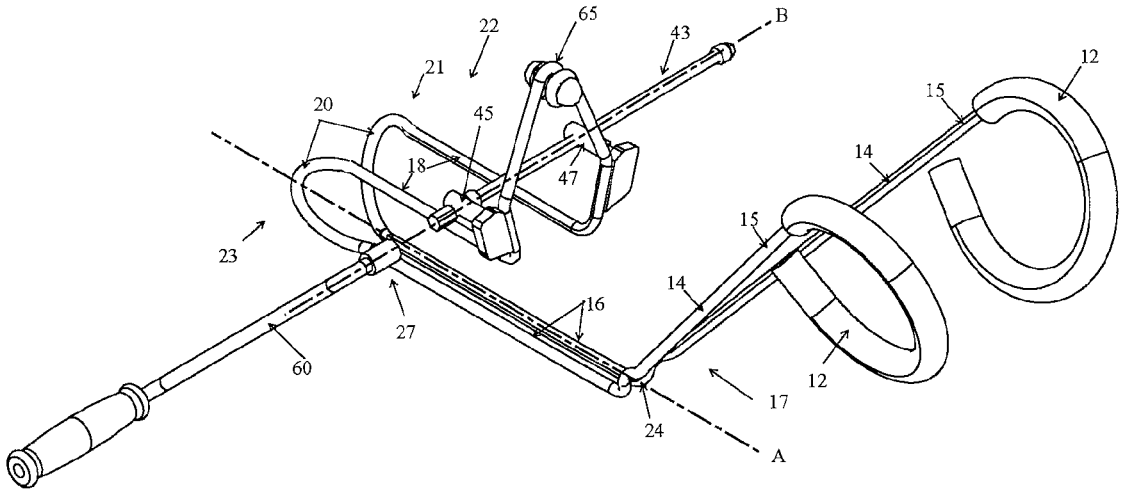
FIG. 3 is an end plan view of one embodiment of the stocking aid device according to the present invention in the retracted position.
Figure 4:
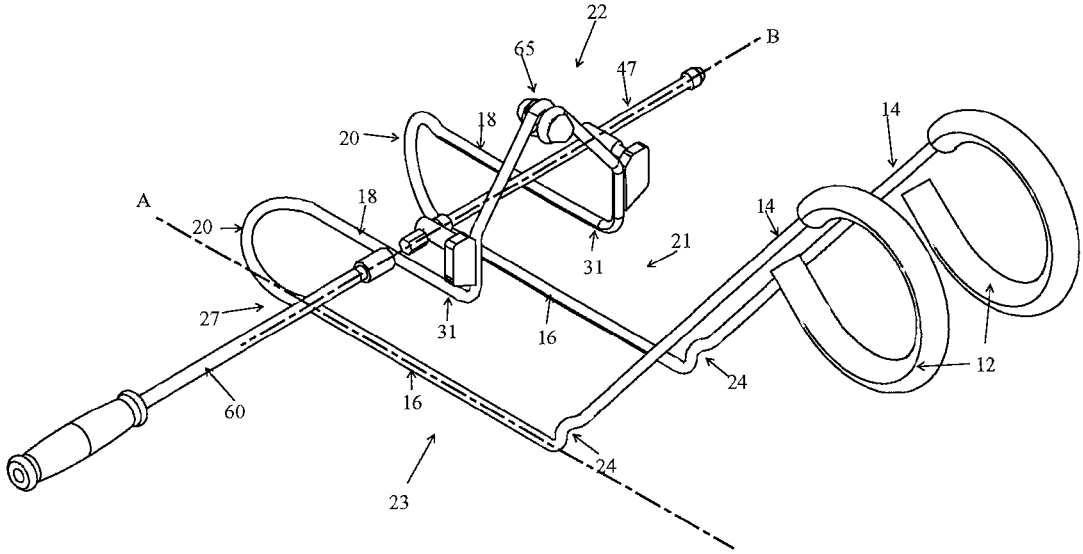
FIG. 4 is an end plan view of one embodiment of the stocking aid device according to the present invention in the expanded position.
Figure 5:
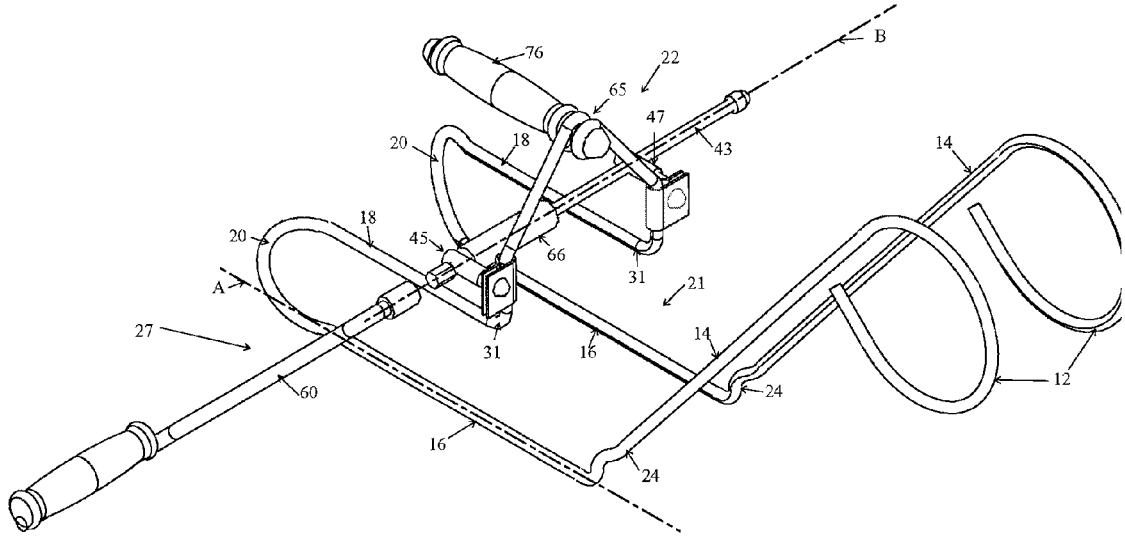
FIG. 5 is a front plan view of another embodiment of the stocking aid device having an additional handle according to the present invention.

According to one embodiment, the present invention features a stocking aid device 10, FIG. 1, which facilitates putting on a sock or stocking, especially for someone with limited strength and/or mobility. The stocking aid device 10 includes a handle region 11, a sock retainer 13, and a spreader 22. As will be explained in greater detail hereinbelow, a sock is inserted over the sock retainer 13 while in a retracted position as shown in FIGS. 1 and 3. The sock retainer 13 is expanded as shown in FIGS. 2 and 4 using the spreader 22 which causes the sock to be stretched open. Using the handle region 11, the user slips the expanded sock over their foot. The spreader 22 expands the sock retainer 13 (and consequently the sock) sufficiently such that the sock exerts minimal resistance when the user slips it over their foot.

The handle region 11 preferably includes two handles 12 each disposed proximate a first end 15 of an elongated vertical member 14. The handles 12 optionally include a gripping area (such as neoprene or a soft, mold material, rubberized coating). The handle region 11 is preferably long enough such that the user to can hold the handles 12 while putting the sock on over their foot with minimal bending. Optionally, the stocking aid device 10 may also feature one or more additional handles 76 disposed proximate the stock retainer 13 which provides another grasping point that further aids and facilitates the gripping of the stocking aid device 10. In the preferred embodiment, the additional handles 76 feature a single handle 76 extending outwardly from the pivot 65 and away from handle region 11.

The sock retainer 13 is preferably connected to the handle region 11 and includes a first and a second side 21, 23 that are substantially mirror images of each other and which are sized and shaped to accept at least a potion of a sock. As will be explained in greater detail hereinbelow, the first and second sides 21, 23 are expanded and retracted by the spreader 22 to facilitate putting on a sock over a user's foot. The handle region 11 and sock retainer 13 may be constructed of a metal alloy, plastic or composite. In an exemplary embodiment, the stocking aid device 10 may be made with a tubular aluminum alloy.

Each side 21, 23 of the sock retainer 13 includes a heel region 24 disposed between the second ends 17 of the elongated vertical members 14 of the handles 12 and the lower substantially horizontal member 16 of the sock retainer 13. A flared region 20 connects the lower substantially horizontal member 16 to the upper substantially member 18. The flared region 20 preferably includes a generally "U" shaped area that flares outward and away from the longitudinal axis A of the upper and lower substantially horizontal members 16, 18 while in the retracted position.

With the stocking aid device 10 in the retracted position as shown in FIGS. 1 and 3, the opening of the sock is inserted over the flared region 20 and the lower and upper substantially horizontal members 16, 18 of the sock retainer 13 such that substantially only the toe portion of the sock is disposed around the flared region 20. The flared region 20 spreads the sock in the toe region thereby accommodating a wide variety of foot and toe shapes including bunions or other sensitive foot and toe disfigurements. The bottom half of the sock is pulled along the length of the lower horizontal member 16 until the heel and ankle portions of the sock are disposed about the heel region 24 of the sock retainer 13. As best seen in FIGS. 2 and 4, the heel region 24 of the sock retainer 13 forms a lip 30 that is sized and shaped to engage the heel portion of the sock and prevent the sock from accidentally slipping off the sock retainer 13. The top half of the sock is pulled along the length of the upper horizontal member 18 such that ankle portion of the sock is proximate a second end 31 of the upper horizontal member 18.

Once the sock has been placed over the sock retainer 13, the spreader 22 is used to move the sock retainer 13 from the retracted position as shown in FIGS. 1 and 3 to the extended position as shown in FIGS. 2 and 4. The spreader 22 preferably moves the first and second side 21, 23 of the sock retainer 13 generally outwardly and perpendicular to the longitudinal axis A of the upper and lower substantially horizontal members 16, 18.

The spreader 22 includes any device or mechanism for altering the distance between the first and second side 21, 23 of the sock retainer 13. In the preferred embodiment, the spreader 22 includes a screw gear or the like 41. The screw gear 41 includes a threaded rod 43 disposed through a first aperture 45 and at least a second aperture 47 proximate the second ends 31 of the upper substantially horizontal members 18. In the preferred embodiment, the second aperture 47 is internally threaded and engages the threads of the threaded rod 43. Alternatively, the first aperture 45 could be threaded.

To expand the stocking aid device 10, the threaded rod 43 is rotated using a hand crank 50, electric motor (for example, but not limited to, a battery operated drill 60 or the like as shown in FIG. 4), or any other device known to those skilled in the art. As the threaded rod 43 is rotated, the threads of the threaded rod 43 engage the internal threads of the second aperture 47 thereby causing the second aperture 47 (and consequently the first and second sides 21, 23 of the sock retainer 13) to move along the longitudinal axis B of the threaded rod 43. The treaded rod 43 may also incorporate stop points to prevent the over expanding or over retracting of the stocking aid device 10, for example, a locking bolt configuration (not shown) may be used to prevent the threaded rod's 43 movement through the second aperture 47. The hand crank 50 may be permanently coupled to the thread rod 43 or may be removably coupled to the thread rod 43.

In the preferred embodiment, the spreader 22 also includes a pivot 65. Referring specifically to FIGS. 1 and 3, in the retracted position the lower horizontal members 16 are in very close proximity to each other while the upper horizontal members 18 are slightly spread apart. As the stocking aid device 10 is moved from the retracted position (FIGS. 1 and 3) to the extended position (FIGS. 2 and 4), the pivot 65 causes the lower horizontal member 16 to move outwardly more than the upper horizontal members 18. This creates a larger opening for the user. Additionally, the apertures 45, 47 pivot to adjust the changing geometry of the handles 12, 14 as they pivot about the pivot 65.

While the spreader 22 has been described as a screw gear 41, those skilled in the art will recognize that other devices for causing the first and second sides 21, 23 of the sock retainer 13 to expand and retract are possible and the present invention is not limited to just this arrangement unless otherwise specifically claimed as such.

As mentioned above, the present invention is not intended to be limited to a system or method which must satisfy one or more of any stated or implied object or feature of the invention and should not be limited to the preferred, exemplary, or primary embodiment(s) described herein. The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention.

The invention claimed is:

1. A device for facilitating putting on footwear comprising:

a lower member with a first side and a second side wherein the first side and second side are sized to fit within footwear when the lower member is in a retracted position;

a handle coupled to the lower member and sized to allow a user to position the lower member when the user is in a seated position; and a spreader for moving the first side and the second side from a retracted position to a extended position by turning a gear screw coupling the first side and the second side of the spreader wherein the first side and second side are sided to receive a foot of a user in the extended position and the spreader comprises a motor for turning a gear screw coupling the first side and second side of the spreader.

2. The device of claim 1, wherein the first side and second side of the lower portion are separated in the extended position to allow the foot of the user to fit between as the footwear is positioned on the foot.

3. The device of claim 1, wherein the spreader comprises a removable spreader handle sized to allow the user in a seated position to turn the handle of the spreader.

4. The device of claim 1, wherein the first side and second side each have a heel bend configured to prevent slipping of the footwear from the lower portion.

5. The device of claim 1, wherein a front portion of the first side is angled away from a front portion of the second side and the front portion of the second side is angled away from the front portion of the first side.

6. The device of claim 1, wherein the first side and second side of the lower member are made of a rod shaped material.

7. A device for putting on compression stockings comprising:

a first frame with a handle portion and extending away from the handle portion a lower portion having a heel bend and a U-shaped toe portion wherein a bottom segment of the U-shaped toe portion couples to the heel bend and a top segment of the U-shaped toe portion couples to a pivot point;

a second frame with a handle portion and extending away from the handle portion a lower portion having a heel bend and a U-shaped toe portion wherein a bottom segment of the U-shaped toe portion couples to the heel bend and a top segment of the U-shaped toe portion couples to the pivot point of the first frame; and a spreader with crank member for turning a gear screw connecting the top segment of the U-shaped toe portion of the first frame to the top segment of the U-shaped toe portion of the second frame and configured to move the lower portion of the first frame and the lower portion of the second from a retracted position wherein the lower portions are sized to fit within a compression stocking in a relaxed position to an extend position wherein the lower portions are sized to expand the compression stocking to receive a human foot.

8. The device of claim 7, wherein the bottom segment of the toe portion and the heel bend of the first frame and the bottom segment of the toe portion and the heel bend of the second frame are separated in the extended position to allow a user's foot to fit between as the compression stocking is positioned on the user's foot.

9. The device of claim 7, wherein the crank comprises a removable handle sized to allow a seated user to turn the handle of the crank.

10. The device of claim 7, wherein the crank comprises a motor for turning the gear screw.

11. The device of claim 7, wherein the heel bend of the first frame and the heel bend of the second frame are configured to prevent slipping of the stock off the lower portion of the first frame and the lower portion of the second frame.

12. The device of claim 7, wherein a mid section connecting the top segment to the bottom segment of the U-shaped toe portion of the first frame is angled away from the second frame and a section mid connecting the top segment to the bottom segment of the U-shaped toe portion of the second frame is angled away from the first frame.

13. The device of claim 7, wherein the first frame and the second frame are made of a rod shaped material.

14. The device of claim 7, wherein the gear screw has one or more stops to prevent over expansion or overt retraction.

15. A device for facilitating putting on footwear comprising:

a lower member with a first side and a second side wherein the first side and second side are sized to fit within footwear when the lower member is in a retracted position;

a handle coupled to the lower member and sized to allow a user to position the lower member when the user is in a seated position; and a spreader for moving the first side and the second side from a retracted position to an extended position by turning a gear screw coupling the first side and the second side of the spreader wherein the first side and second side are sided to receive a toot of a user in the extended position and the spreader comprises a motor for turning a gear screw coupling the first side and second side of the spreader wherein the gear screw has one or more stops to prevent over expansion or over retraction.

* * * * *